US012114788B2

(12) United States Patent
Miller

(10) Patent No.: US 12,114,788 B2
(45) Date of Patent: Oct. 15, 2024

(54) DUAL INFANT ROCKING DEVICE

(71) Applicant: Letitia Miller, Queens Village, NY (US)

(72) Inventor: Letitia Miller, Queens Village, NY (US)

( * ) Notice: Subject to any disclaimer, the term of this patent is extended or adjusted under 35 U.S.C. 154(b) by 0 days.

(21) Appl. No.: 18/103,523

(22) Filed: Jan. 31, 2023

(65) Prior Publication Data

US 2024/0251968 A1 Aug. 1, 2024

(51) Int. Cl.
*A47D 13/10* (2006.01)
*A47C 3/025* (2006.01)

(52) U.S. Cl.
CPC ..... *A47D 13/107* (2013.01); *A47C 3/0251* (2018.08)

(58) Field of Classification Search
CPC ..... A47C 3/0257; A47C 3/02; A47C 3/026; A47C 3/0251; A47D 1/08; A47D 1/002; A47D 13/10; A47D 13/105; A47D 13/107
USPC ..... 297/242, 247, 260.2
See application file for complete search history.

(56) References Cited

U.S. PATENT DOCUMENTS 686,914 A * 11/1901 Stark ..... A47C 1/08 297/188.14
4,834,415 A 5/1989 Yee
5,360,258 A * 11/1994 Alivizatos ..... A47D 13/107 5/655
8,844,964 B2 9/2014 Chiang
9,033,415 B2 5/2015 Hopke
D737,062 S 8/2015 Lopez
9,693,638 B1 7/2017 Leach
10,045,635 B2 8/2018 Mountz
10,258,761 B2 4/2019 Smudde
2005/0283908 A1* 12/2005 Wong ..... A47D 9/057 5/105
2009/0200841 A1 8/2009 Rhoten
2011/0165953 A1 7/2011 Solis
2011/0227382 A1* 9/2011 Hay ..... A47C 9/022 297/242

FOREIGN PATENT DOCUMENTS

GB 2541267 2/2017

* cited by examiner

*Primary Examiner* — Milton Nelson, Jr.
(74) *Attorney, Agent, or Firm* — Kyle A. Fletcher, Esq.

(57) ABSTRACT

The dual infant rocking device is adapted for use with two infant/toddlers. The infant/toddlers sit in the dual infant rocking device. The dual infant rocking device is a rocking structure. By rocking structure is meant that the one or more selected individuals seated in the dual infant rocking device are moved in a rhythmic motion relative to the force of gravity. The dual infant rocking device includes a pedestal structure, a plurality of seats, and a control circuit. The pedestal structure, the plurality of seats, and the control circuit are attached to form a single object. The plurality of seats receive the one or more selected individuals. The control circuit provides the motive forces that rock the plurality of seats. The pedestal structure transfers the loads of the plurality of seats, the one or more selected individuals, and the control circuit to a supporting surface.

11 Claims, 6 Drawing Sheets

DUAL INFANT ROCKING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of rocking-chairs, indoor swings, and baby bouncers. (A47D13/10)

SUMMARY OF INVENTION

The dual infant rocking device is a furniture item. The dual infant rocking device is adapted for use with one or more individuals selected from the group consisting of: a) an infant; and, b) a toddler. The selected individuals sit in the dual infant rocking device. The dual infant rocking device is a rocking structure. By rocking structure is meant that the one or more selected individuals seated in the dual infant rocking device are moved in a rhythmic motion relative to the force of gravity. The dual infant rocking device comprises a pedestal structure, a plurality of seats, and a control circuit. The pedestal structure, the plurality of seats, and the control circuit are attached to form a single object. The plurality of seats receive the one or more selected individuals. The control circuit provides the motive forces that rock the plurality of seats. The pedestal structure transfers the loads of the plurality of seats, the one or more selected individuals, and the control circuit to a supporting surface.

These together with additional objects, features and advantages of the dual infant rocking device will be readily apparent to those of ordinary skill in the art upon reading the following detailed description of the presently preferred, but nonetheless illustrative, embodiments when taken in conjunction with the accompanying drawings.

In this respect, before explaining the current embodiments of the dual infant rocking device in detail, it is to be understood that the dual infant rocking device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the dual infant rocking device.

It is therefore important that the claims be regarded as including such equivalent construction insofar as they do not depart from the spirit and scope of the dual infant rocking device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
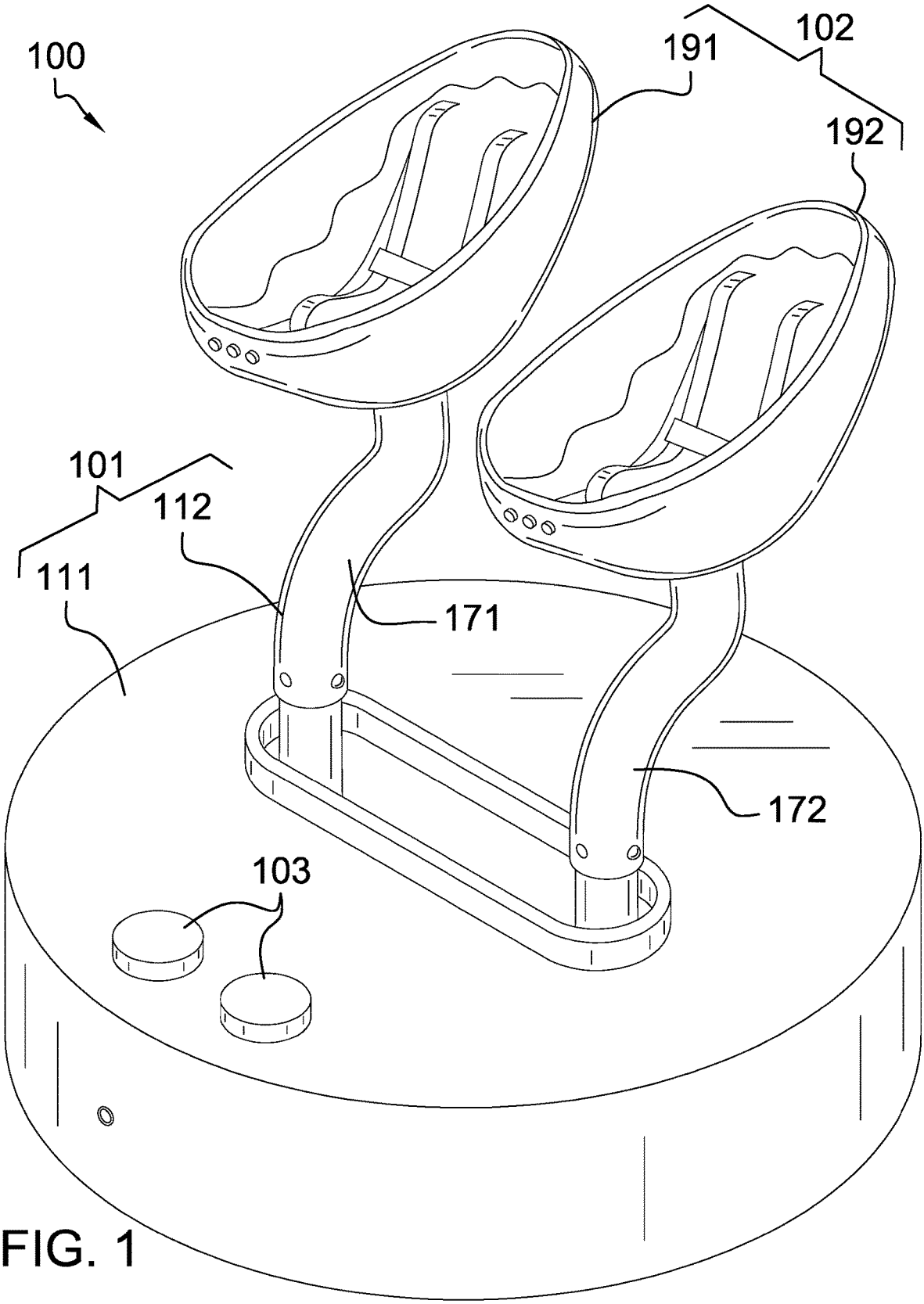
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

The dual infant rocking device 100 (hereinafter invention) is a furniture item. The invention 100 is adapted for use with one or more individuals selected from the group consisting of: a) an infant; and, b) a toddler. The selected individuals sit in the invention 100. The invention 100 is a rocking structure. By rocking structure is meant that the one or more selected individuals seated in the invention 100 are moved in a rhythmic motion relative to the force of gravity. The invention 100 comprises a pedestal structure 101, a plurality of seats 102, and a control circuit 103. The pedestal structure 101, the plurality of seats 102, and the control circuit 103 are attached to form a single object. The plurality of seats 102 receive the one or more selected individuals. The control circuit 103 provides the motive forces that rock the plurality of seats 102. The pedestal structure 101 transfers the loads of the plurality of seats 102, the one or more selected individuals, and the control circuit 103 to a supporting surface.

The pedestal structure 101 is a rigid structure. The pedestal structure 101 is a disk shaped structure. The pedestal structure 101 is a load bearing structure. The pedestal structure 101 rests on a supporting surface. The pedestal structure 101 forms the inferior structure of the invention 100. The pedestal structure 101 forms a load path that transfers the load of the invention 100 to a supporting surface. The pedestal structure 101 comprises a pedestal base 111 and a plurality of stanchion structures 112.

The pedestal base 111 is a rigid structure. The pedestal base 111 is a disk shaped structure. The pedestal base 111 is a load bearing structure. The pedestal base 111 rests on a supporting surface. The pedestal base 111 forms the inferior structure of the invention 100. The pedestal base 111 forms the final link in load path that transfers the load of the invention 100 to a supporting surface.

The plurality of stanchion structures 112 attach to the pedestal base 111. The plurality of stanchion structures 112 further comprises a collection of individual stanchions 141. Each individual stanchion 141 selected from the plurality of stanchion structures 112 is identical. Each individual stanchion 141 selected from the plurality of stanchion structures 112 is a rigid structure. Each selected individual stanchion 141 has a non-Euclidean shape. Each individual seat 121 selected from the plurality of seats 102 attaches to the superior congruent end of the non-Euclidean prism structure of the selected individual stanchion 141. Each selected individual stanchion 141 elevates its associated selected individual seat 121 above the pedestal base 111.

Each individual stanchion 141 selected from the plurality of stanchion structures 112 further comprises a non-Euclidean arm 142, a locking hinge 143, and a slewing bearing 144.

The non-Euclidean arm 142 is a rigid structure. The non-Euclidean arm 142 is a load bearing structure. The non-Euclidean arm 142 attaches the associated individual seat 121 to the pedestal base 111 of the pedestal structure 101. The non-Euclidean arm 142 has a non-Euclidean prism shape. The associated individual seat 121 attaches to the congruent end of the non-Euclidean arm 142 that is distal from the pedestal base 111. The non-Euclidean arm 142 elevates the associated individual seat 121 above the pedestal base 111. The non-Euclidean arm 142 is an adjustable structure. The non-Euclidean arm 142 is a rotating structure. The non-Euclidean arm 142 rotates around a horizontally oriented axis of rotation such that the cant between the force of gravity and the spine of the selected individual sitting in the associated individual seat 121 is adjustable.

The locking hinge 143 is a locking hinge. The locking hinge is defined elsewhere in this disclosure. The locking hinge 143 is a mechanism that is formed within the non-Euclidean arm 142. The locking hinge 143 enables the rotation of the non-Euclidean arm 142 around the horizontally oriented axis of rotation. The locking nature of the locking hinge 143 locks the cant between the force of gravity and the spine of the selected individual sitting in the associated individual seat 121 into a fixed position.

The slewing bearing 144 is a fastening device. The slewing bearing 144 is defined elsewhere in this disclosure. The slewing bearing 144 attaches the congruent end of the non-Euclidean arm 142 that is distal from the associated individual seat 121 to the pedestal base 111. The slewing bearing 144 attaches the non-Euclidean arm 142 to the pedestal base 111 such that the non-Euclidean arm 142 rotates around the vertically oriented axis of rotation.

Each individual seat 121 selected from the plurality of seats 102 is a chair. Each selected individual seat 121 forms a structure that supports a selected individual. Each selected individual seat 121 attaches to the superior congruent end of the non-Euclidean prism structure of an individual stanchion 141 selected from the plurality of stanchion structures 112. The selected individual seat 121 transfers the load of the selected individual to the individual stanchion 141 attached to the selected individual seat 121. The plurality of seats 102 comprises a collection of individual seats 121.

Each individual seat 121 selected from the plurality of seats 102 removably attaches to its associated individual stanchion 141 such that the plurality of seats 102 are interchangeable. Each selected individual stanchion 141 forms a load path that transfers the load borne by the attached individual seat 121 to the pedestal base 111. Each individual stanchion 141 selected from the plurality of stanchion structures is a rotating structure. Each selected individual stanchion 141 rotates relative to a horizontally oriented axis of rotation such that the cant between the force of gravity and the spine of the selected individual sitting in the associated individual seat 121 is adjustable. Each selected individual stanchion 141 further rotates relative to a vertically oriented axis of rotation such that the plurality of seats 102 can be rotated to face each other.

Each individual seat 121 selected from the plurality of seats 102 is a chair. Each selected individual seat 121 mounts on the congruent end of the non-Euclidean prism structure of the individual stanchion 141 selected from the plurality of stanchion structures 112 associated with the selected individual seat 121. Each individual seat 121 is adapted for use in supporting the selected individual.

The control circuit 103 is an electric circuit. The control circuit 103 converts electric energy into mechanical energy. The mechanical energy generated by the control circuit 103 generates a rhythmic motion for each individual seat 121 selected from the plurality of seats 102. The control circuit 103 controls the speed of rotation of each selected individual seat 121. The control circuit 103 independently controls the rotation of each selected individual seat 121. By independently control is meant that the rotation and the rate of rotation of any seat initially selected from the plurality of seats 102 is not influenced by the rotation and the rate of rotation of any seat subsequently selected from the plurality of seats 102. The control circuit 103 further comprises a plurality of limited arc motor 161 structures 131 and an external power source 132. The plurality of limited arc motor 161 structures 131 and the external power source 132 are electrically interconnected.

Each external power source 132 is an externally provided source of electric energy. The external power source 132 provides the electric energy necessary to operate the plurality of limited arc motor 161 structures 131.

The plurality of limited arc motor 161 structures 131 comprises a collection of individual limited arc motor 161 structures 151. Each individual limited arc motor 161 structure 151 selected from the plurality of limited arc motor 161 structures 131 is identical. Each individual limited arc motor 161 structure 151 selected from the plurality of limited arc motor 161 structures 131 comprises an individual limited arc motor 161, an individual limited arc motor 161 controller 162, an individual potentiometer 163, and an individual master switch 164. The individual limited arc motor 161, the individual limited arc motor 161 controller 162, the individual potentiometer 163, and the individual master switch 164 are electrically interconnected.

Each individual limited arc motor 161 structure 151 selected from the plurality of limited arc motor 161 structures 131 is a mechanical structure. Each selected individual limited arc motor 161 structure 151 is an electrically powered device. Each selected individual limited arc motor 161 structure 151 converts electric energy into mechanical energy. Each individual limited arc motor 161 structure 151 selected from the plurality of limited arc motor 161 structures 131 is associated with an individual seat 121 selected from the plurality of seats 102. Each individual limited arc motor 161 structure 151 selected from the plurality of limited arc motor 161 structures 131 provides the motive forces necessary to rock its associated individual seat 121.

The individual limited arc motor 161 is an electric motor. The individual limited arc motor 161 is a limited arc motor. The limited arc motor is defined elsewhere in this disclosure. The individual limited arc motor 161 converts electric energy into a rotational energy that rotates the individual seat 121 associated with the individual limited arc motor 161 over a limited arc.

The individual limited arc motor 161 controller 162 is a motor controller. The individual limited arc motor 161 controller 162 electrically connects to the individual limited arc motor 161. The individual limited arc motor 161 controller initiates the operation of the individual limited arc motor 161. The individual limited arc motor 161 controller 162 discontinues the operation of the individual limited arc motor 161. The individual limited arc motor 161 controller 162 controls the direction of rotation of the individual limited arc motor 161. The individual limited arc motor 161 controller 162 controls the speed of rotation of the individual limited arc motor 161.

The individual potentiometer 163 is an electric circuit element that electrically connects to the individual limited arc motor 161 controller 162. The individual potentiometer 163 is a variable resistance device. The individual potentiometer 163 forms an interface used to provide the individual limited arc motor 161 controller 162 with the desired speed of rotation of the individual limited arc motor 161.

The individual master switch 164 is a maintained electric switch. The individual master switch 164 forms an electric connection between the individual limited arc motor 161 controller 162 and the external power source 132. The individual master switch 164 controls the flow of electric energy from the external power source 132 into the individual limited arc motor 161 controller 162. The individual master switch 164 is essentially the power switch for the individual limited arc motor 161 structure 151.

In the first potential embodiment of the disclosure, the plurality of stanchion structures 112 further comprises a first stanchion structure 171 and a second stanchion structure 172. The first stanchion structure 171 is a first individual stanchion 141 selected from the plurality of stanchion structures 112. The first stanchion structure 171 is the individual stanchion 141 selected to attach the first seat 191 to the pedestal base 111. The second stanchion structure 172 is a second individual stanchion 141 selected from the plurality of stanchion structures 112. The second stanchion structure 172 is the individual stanchion 141 selected to attach the second seat 192 to the pedestal base 111.

In the first potential embodiment of the disclosure, the plurality of seats 102 further comprises a first seat 191 and a second seat 192. The first seat 191 is the individual seat 121 selected from the plurality of seats 102 that attaches to the first stanchion structure 171 selected from the plurality of stanchion structures 112 of the pedestal structure 101. The second seat 192 is the individual seat 121 selected from the plurality of seats 102 that attaches to the second stanchion structure 172 selected from the plurality of stanchion structures 112 of the pedestal structure 101. The first seat 191 is adapted to receive and support a first selected individual. The second seat 192 is adapted to receive and support a second selected individual.

In the first potential embodiment of the disclosure, the plurality of limited arc motor 161 structures 131 further comprises a first limited arc motor 161 structure 181 and a second limited arc motor 161 structure 182. The first limited arc motor 161 structure 181 is a first individual limited arc motor 161 structure 151 selected from the plurality of limited arc motor 161 structures 131. The first limited arc motor 161 structure 181 is the individual limited arc motor 161 structure 151 used to rock the first seat 191. The first limited arc motor 161 structure 181 is a second individual limited arc motor 161 structure 151 selected from the plurality of limited arc motor 161 structures 131. The second limited arc motor 161 structure 182 is the individual limited arc motor 161 structure 151 used to rock the second seat 192.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Arc: As used in this disclosure, an arc refers to a portion of a circumference or a curved perimeter. When applied to an angle or cant, the arc also refers to a measure of an angular span as measured from a circle at the vertex formed by the sides of the angle.

Barrier: As used in this disclosure, a barrier is a physical obstacle that forms a boundary between a first space and a second space. The barrier prevents the passage of an object between the first space and the second space.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Chair: As used in this disclosure, a chair is a structure that a person can sit on. The horizontal resting surface a person sits on is called the bench. Seat is a common synonym for a chair. A sofa refers to a chair that seats more than one person.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Electric Motor: In this disclosure, an electric motor is a machine that converts electric energy into rotational mechanical energy. An electric motor typically comprises a stator and a rotor. The stator is a stationary hollow cylindrical structure that forms a magnetic field. The rotor is a magnetically active rotating cylindrical structure that is coaxially mounted in the stator. The magnetic interactions between the rotor and the stator physically causes the rotor to rotate within the stator thereby generating rotational mechanical energy. This disclosure assumes that the power source is an externally provided source of DC electrical power. The use of DC power is not critical and AC power can be used by exchanging the DC electric motor with an AC motor that has a reversible starter winding.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Euclidean Surface: As used in this disclosure, a Euclidean surface refers to a two-dimensional plane that is formed without a curvature. By without a curvature is meant that the shortest distance between any two points on a Euclidean surface forms a line that remains on the Euclidean surface.

Exterior: As used in this disclosure, the exterior is used as a relational term that implies that an object is not contained within the boundary of a structure or a space.

External Power Source: As used in this disclosure, an external power source is a source of the energy that is externally provided to enable the operation of the present disclosure. Examples of external power sources include, but are not limited to, electrical power sources and compressed air sources.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term roughly geometrically similar is meant that the primary shapes of two objects are geometrically similar except that there are functional items (such as fastening devices) associated with the primary shape may not maintain the ratio for geometric similarity.

Hinge: As used in this disclosure, a hinge is a device that permits the turning, rotating, or pivoting of a first object relative to a second object. A hinge designed to be fixed into a set position after rotation is called a locking hinge. A spring loaded hinge is a hinge formed as an elastic structure. The elastic structure of the spring loaded hinge is deformed under a rotating force such that the elastic structure returns the spring loaded hinge back to its relaxed shape after the rotating force is removed from the spring loaded hinge.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Independent: As used in this disclosure, the term independent refers to the relationship between the operation and control of a first device and a second device. The first device and the second device are independent from each other if: a) the operation of the first device is neither impacted nor influenced by the operation of the second device; and, b) the operation of the second device is neither impacted nor influenced by the operation of the first device.

Infant: As used in this disclosure, an infant refers to a human child who: 1) is under 18 months old; and, 2) has not yet learned to walk.

Inferior: As used in this disclosure, the term inferior refers to a directional reference that is parallel to and in the same direction as the force of gravity when an object is positioned or used normally.

Interchangeable: As used in this disclosure, interchangeable refers to the ability to remove and replace an element of a structure. For example, if a first object that is attached to a structure can be removed and replaced with a second object selected from a plurality of compatible objects than the first object is said to be replaceable with both: 1) the second object; and, 2) each of the elements of compatible objects. Term interchangeable is commonly associated with tools.

Interchangeable objects are often used to change the function or the performance characteristics of a tool.

Interior: As used in this disclosure, the interior is used as a relational term that implies that an object is contained within the boundary of a structure or a space.

Interval: As used in this disclosure, the term interval refers to a measure of the distance within an organizational structure between the positions of a first event and a second event that are contained within the organizational structure. The term regular interval is often used to mean that the span of distance between multiple occurrences of the first event and the second event remains constant. This disclosure assumes that the selected second event can be a repetition of the first event. The term interval is often applied to the structure of time and in this context is taken to mean the period of time that passes the first event and the second event.

Limited Arc Motor: As used in this disclosure, a limited arc motor is an electric motor that converts externally provided energy into a limited arc rotation.

Limited Arc Rotation: As used in this disclosure, a limited arc rotation refers the rotation of a structure that: a) has a regular cycle structure that regularly reverses the direction of rotation of the structure; and, b) has an arc of rotation of less than 360 degrees.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Maintained Switch: As used in this disclosure, a maintained switch is a switch that maintains the position that was set in the most recent switch actuation. A maintained switch works in an opposite manner to a momentary switch.

Motor: As used in this disclosure, a motor refers to the method of transferring energy from an external power source into rotational mechanical energy.

Motor Controller: As used in this disclosure, a motor controller is an electrical device that is used to control the rotational speed, or simply the speed, and the direction of rotation of an electric motor. Motor controllers will generally receive one or more inputs which are used determine the desired rotational speed and direction of rotation of the electric motor.

Negative Space: As used in this disclosure, negative space is a method of defining an object through the use of open or empty space as the definition of the object itself, or, through the use of open or empty space to describe the boundaries of an object.

Non-Euclidean Plane: As used in this disclosure, a non-Euclidean plane (or non-Euclidean surface) is a geometric plane that is formed with a curvature such that: a) two parallel lines will intersect somewhere in the planar surface; or, b) the span of the perpendicular distance between two parallel lines will vary as a function of the position of the plane; or, c) the minimum distance between two points on the non-Euclidean plane as measured along the non-Euclidean plane is greater than the absolute minimum distance between the same two points. In many geometries, the statements (a) and (b) can be considered identical statements. A non-Euclidean plane is said to form a roughly Euclidean surface (or plane) when the span of the minimum distance between two points on the non-Euclidean plane as measured along the non-Euclidean plane is less than or equal to 1.1 times the absolute minimum distance between the same two points.

Non-Euclidean Prism: As used in this disclosure, a non-Euclidean prism is a prism structure wherein the center axis of the prism lies on a non-Euclidean plane or is otherwise formed with a curvature.

Non-Euclidean Structure: As used in this disclosure, a non-Euclidean structure is a structure wherein: a) the non-Euclidean structure is formed with a non-Euclidean plane; b) the non-Euclidean structure has an axis that lies on a non-Euclidean plane or is otherwise formed with a curvature; or, c) a combination of both (a) and (b) above.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Pedestal: As used in this disclosure, a pedestal is an intermediary load bearing structure that forms a load path between two objects or structures.

Perimeter: As used in this disclosure, a perimeter is one or more curved or straight lines that bounds an enclosed area on a plane or surface. The perimeter of a circle is commonly referred to as a circumference.

Pivot: As used in this disclosure, a pivot is a rod or shaft around which an object rotates or swings.

Potentiometer: As used in this disclosure, a potentiometer is an adjustable electrical device that presents a resistance to an electric. The level of resistance is adjustable.

Primary Shape: As used in this disclosure, the primary shape refers to a description of the rough overall geometric shape of an object that is assembled from multiple components or surfaces. Use Roughly Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a negative space within which an object is stored. The protected space is enclosed by a barrier structure that: a) prevents damage to the object contained within the protected space; b) maintains conditions that are appropriate for the object; c) protects the object within the protected space from potential dangers that are outside of the protected space; or, d) maintains the privacy of the object within the protected space.

Resistance: As used in this disclosure, resistance refers to the opposition provided by an electrical circuit (or circuit element) to the electrical current created by a DC voltage is presented across the electrical circuit (or circuit element). The term impedance is often used for resistance when referring to an AC voltage that is presented across the electrical circuit (or circuit element).

Resistor: As used in this disclosure, a resistor is a well-known and commonly available electrical device that presents a resistance that inhibits the flow of electricity through an electric circuit. Within an electric circuit processing alternating currents, the resistor will not affect the phase of the alternating current. A current flowing through a resistor will create a voltage across the terminals of the resistor.

Rhythm: As used in this disclosure, a rhythm refers to a pattern that repeats at regular intervals.

Rigid Structure: As used in this disclosure, a rigid structure is a solid structure formed from an inelastic material that resists changes in shape. A rigid structure will permanently deform as it fails under a force. See bimodal flexible structure.

Rotation: As used in this disclosure, rotation refers to the cyclic movement of an object around a fixed point or fixed axis. The verb of rotation is to rotate.

Seat: As used in this disclosure, a seat is a structure that a person can sit on. Chair is a common synonym for a seat.

Slewing Bearing: As used in this disclosure, a slewing bearing is a device that is used to rotate an object on a horizontal surface. Slewing bearings are typically load bearing structures Slewing bearings are often called turntable bearings or a lazy Susan bearing.

Stanchion: As used in this disclosure, a stanchion refers to a vertically oriented prism-shaped pole, post, or support.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Time: As used in this disclosure, time refers to a structure within which the sequence of all events from the past, through present, and into the future can be organized. Time also refers to a measure of the interval between the occurrence of a first event and the occurrence of a second event within the structure of time.

Toddler: As used in this disclosure, a toddler is a human child between the ages of one and three who has learned to walk.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Figure 2:
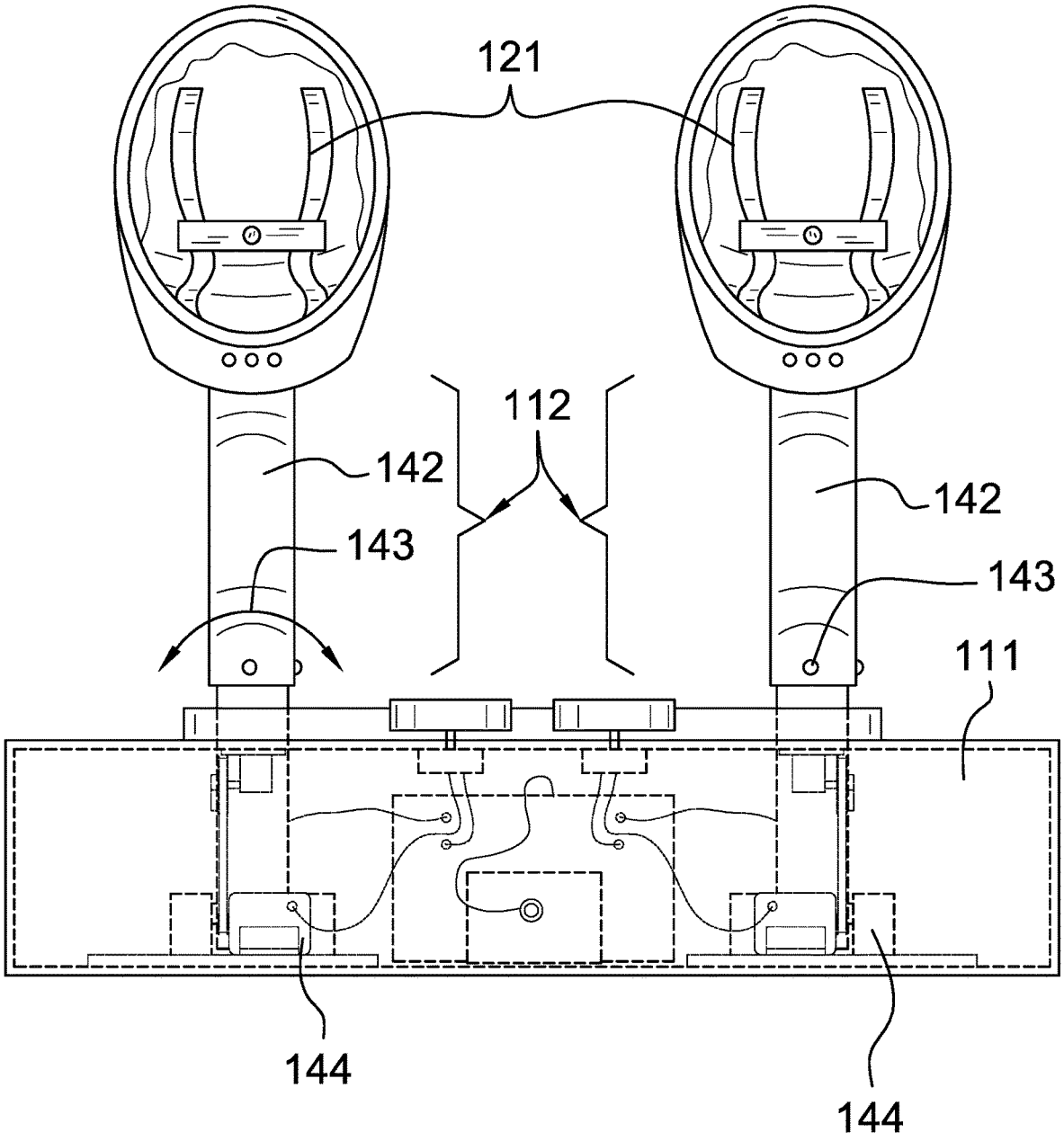
FIG. 2 is a front view of an embodiment of the disclosure.
Figure 3:
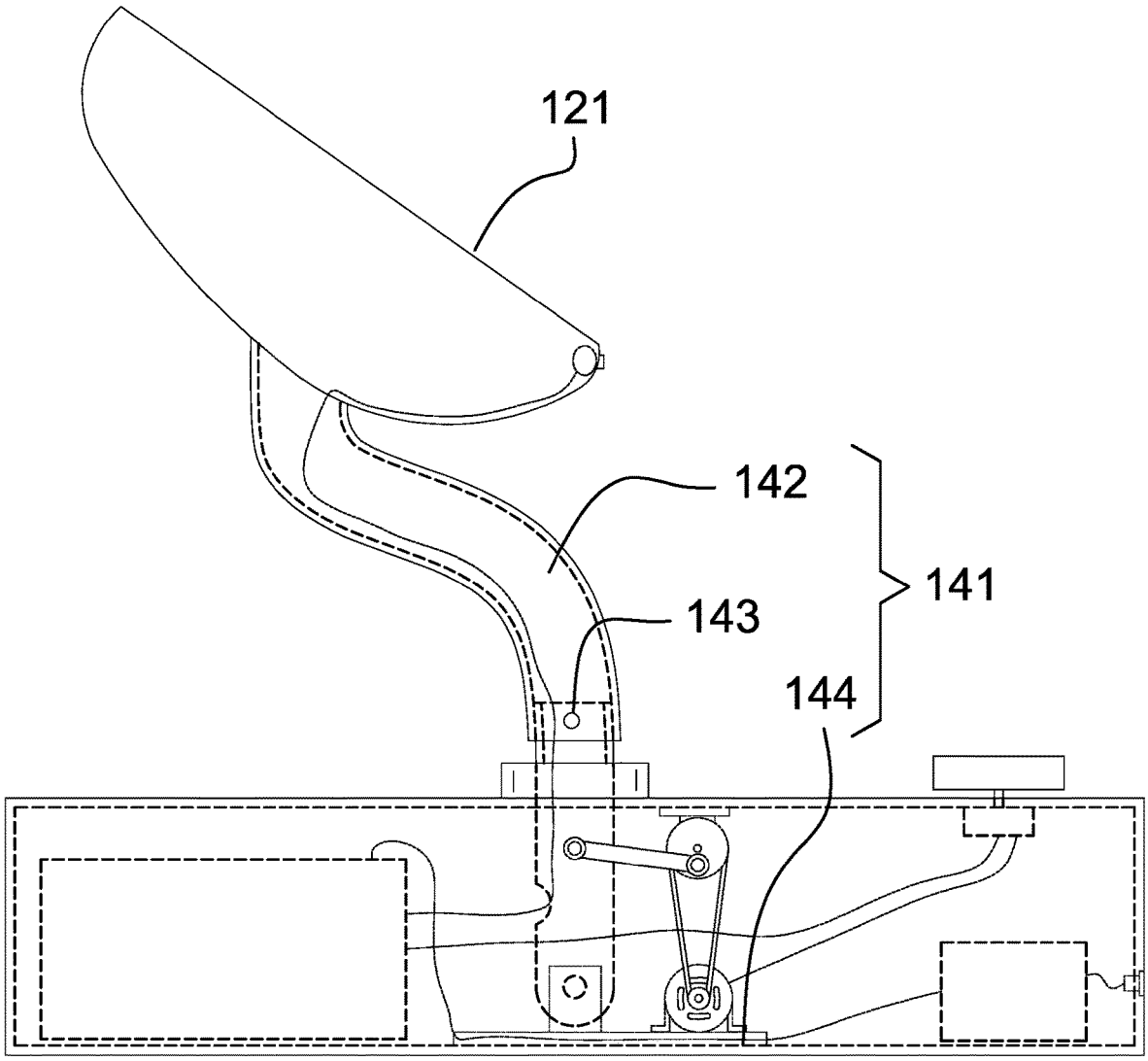
FIG. 3 is a side view of an embodiment of the disclosure.
Figure 4:
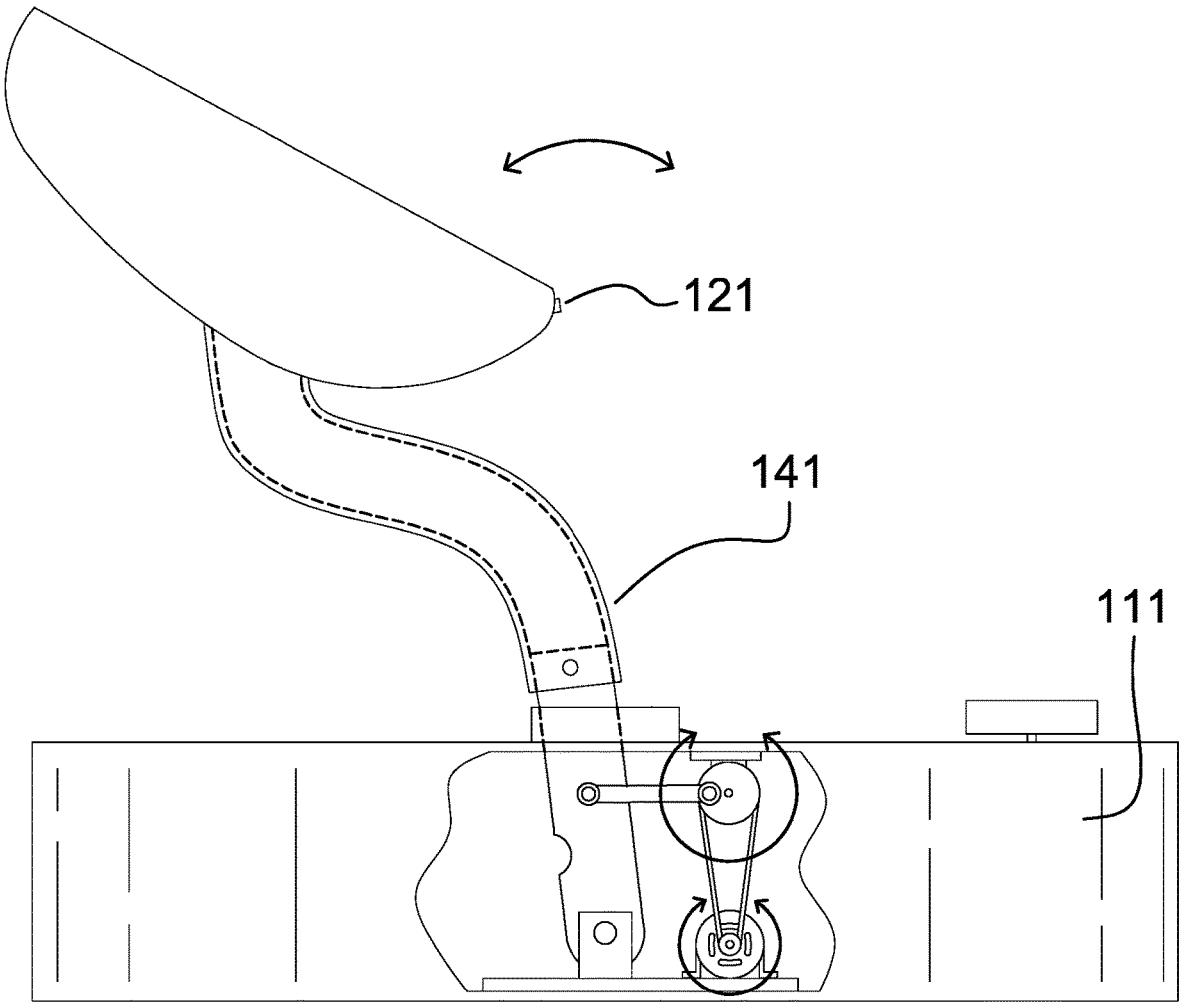
FIG. 4 is a side view of an embodiment of the disclosure.
Figure 5:
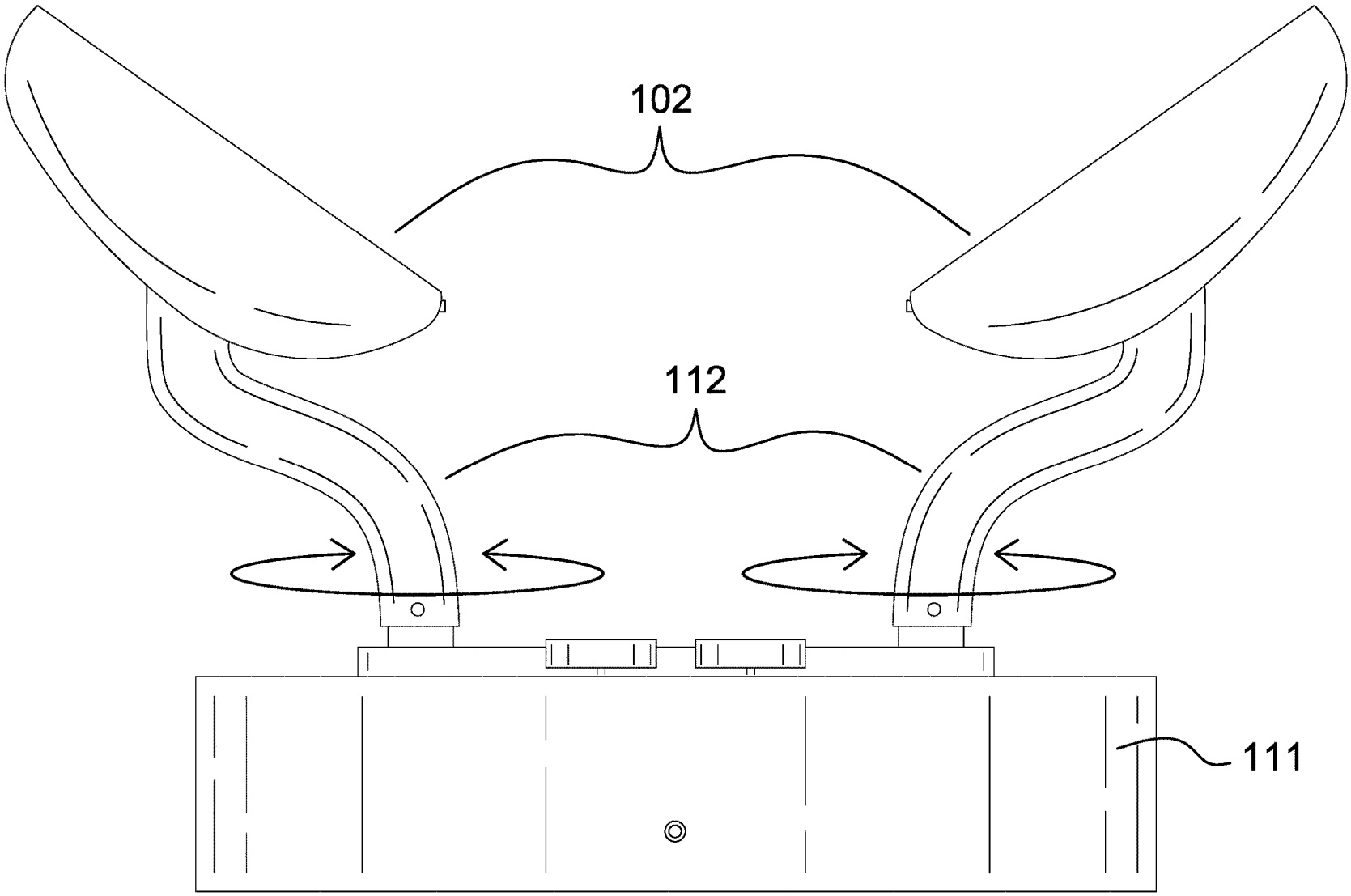
FIG. 5 is a detail view of an embodiment of the disclosure.
Figure 6:
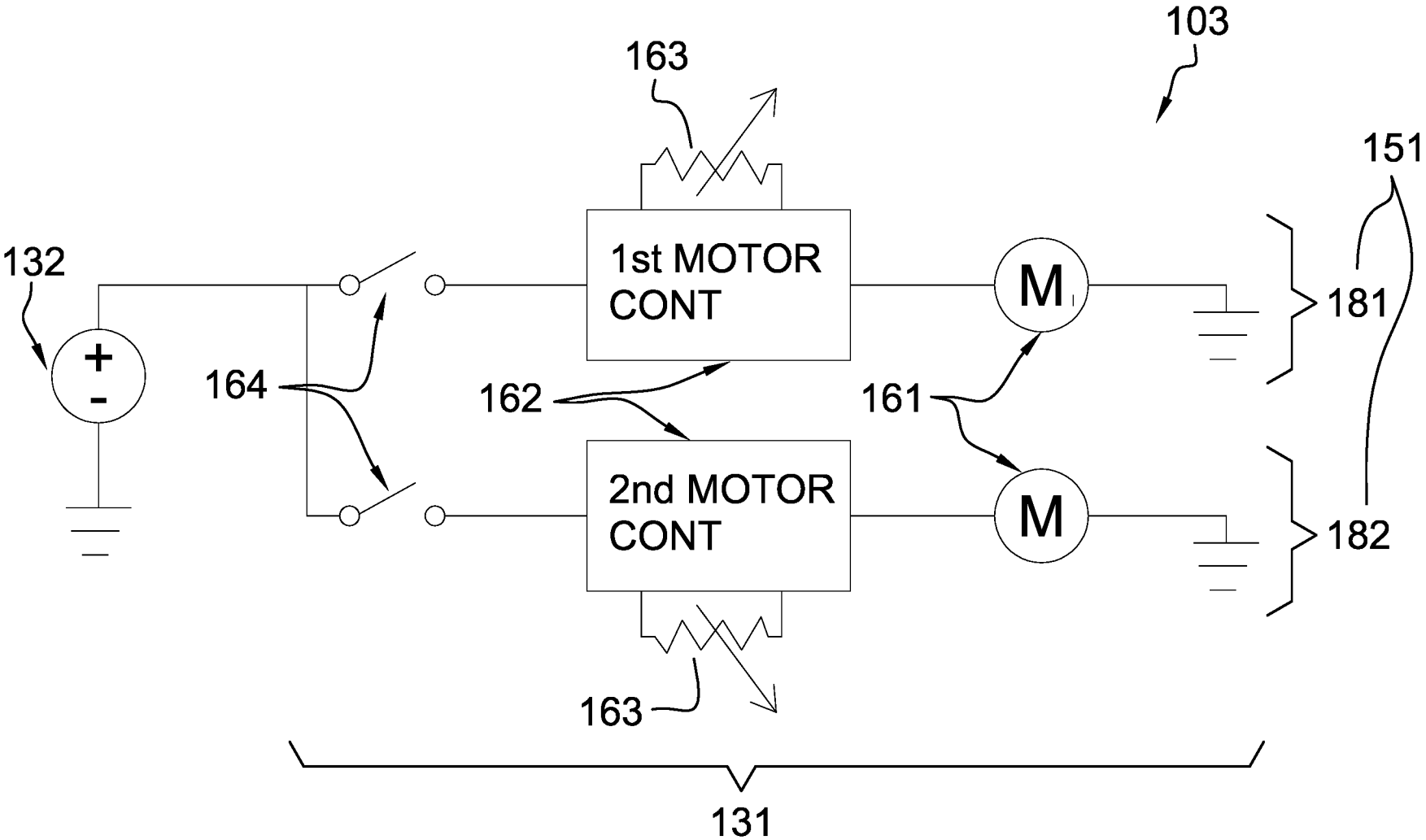
FIG. 6 is a schematic view of an embodiment of the disclosure.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A dual infant rocking device comprising a pedestal structure, a plurality of seats, and a control circuit;

wherein the pedestal structure, the plurality of seats, and the control circuit are attached to form a single object;

wherein the dual infant rocking device is a furniture item;

wherein the dual infant rocking device is adapted for use with one or more individuals selected from the group consisting of: a) an infant; and, b) a toddler;

wherein the selected individuals sit in the dual infant rocking device;

wherein the dual infant rocking device is a rocking structure;

wherein by rocking structure is meant that the one or more selected individuals seated in the dual infant rocking device are moved in a rhythmic motion relative to the force of gravity;

wherein the plurality of seats receive the one or more selected individuals;

wherein the control circuit provides motive forces that rock the plurality of seats;

wherein the pedestal structure transfers the loads of the plurality of seats, the one or more selected individuals, and the control circuit to a supporting surface;

wherein the pedestal structure is a rigid structure;

wherein the pedestal structure is a disk shaped structure;

wherein the pedestal structure is a load bearing structure;

wherein the pedestal structure rests on a supporting surface;

wherein the pedestal structure forms an inferior structure of the dual infant rocking device;

wherein the pedestal structure forms a load path that transfers the load of the dual infant rocking device to a supporting surface.

2. The dual infant rocking device according to claim 1 wherein each individual seat selected from the plurality of seats is a chair;

wherein each selected individual seat forms a structure that supports a selected individual;

wherein each selected individual seat attaches to a superior congruent end of a non-Euclidean prism structure of an individual stanchion selected from a plurality of stanchion structures;

wherein the selected individual seat transfers the load of the selected individual to the individual stanchion attached to the selected individual seat;

wherein the plurality of seats comprises a collection of individual seats;

wherein each individual seat selected from the plurality of seats removably attaches to its associated individual stanchion such that the plurality of seats are interchangeable;

wherein each selected individual stanchion forms a load path that transfers the load borne by the attached individual seat to the pedestal base.

3. The dual infant rocking device according to claim 2 wherein the control circuit is an electric circuit;

wherein the control circuit converts electric energy into mechanical energy;

wherein the mechanical energy generated by the control circuit generates a rhythmic motion for each individual seat selected from the plurality of seats;

wherein the control circuit controls a speed of rotation of each selected individual seat;

wherein the control circuit independently controls the rotation of each selected individual seat;

wherein by independently control is meant that the rotation and a rate of rotation of any seat initially selected from the plurality of seats is not influenced by the rotation and the rate of rotation of any seat subsequently selected from the plurality of seats.

4. The dual infant rocking device according to claim 3 wherein the pedestal structure comprises a pedestal base and the plurality of stanchion structures;

wherein the plurality of stanchion structures attach to the pedestal base.

5. The dual infant rocking device according to claim 4 wherein the control circuit further comprises a plurality of limited arc motor structures and an external power source;

wherein the plurality of limited arc motor structures and the external power source are electrically interconnected.

6. The dual infant rocking device according to claim 5 wherein the plurality of stanchion structures attach to the pedestal base.

7. The dual infant rocking device according to claim 6 wherein the plurality of stanchion structures further comprises a collection of individual stanchions;

wherein each individual stanchion selected from the plurality of stanchion structures is identical;

wherein each individual stanchion selected from the plurality of stanchion structures is a rigid structure;

wherein each selected individual stanchion has a non-Euclidean shape;

wherein each individual seat selected from the plurality of seats attaches to the superior congruent end of the non-Euclidean prism structure of the selected individual stanchion;

wherein each selected individual stanchion elevates its associated selected individual seat above the pedestal base.

8. The dual infant rocking device according to claim 7 wherein each individual stanchion selected from the plurality of stanchion structures further comprises a non-Euclidean arm, a locking hinge, and a slewing bearing;

wherein the non-Euclidean arm is a rigid structure;

wherein the non-Euclidean arm is a load bearing structure;

wherein the non-Euclidean arm attaches the associated individual seat to the pedestal base of the pedestal structure;

wherein the associated individual seat attaches to the superior congruent end of the non-Euclidean arm that is distal from the pedestal base;

wherein the non-Euclidean arm elevates the associated individual seat above the pedestal base;

wherein the non-Euclidean arm is an adjustable structure;

wherein the non-Euclidean arm is a rotating structure;

wherein the non-Euclidean arm rotates around a horizontally oriented axis of rotation such that the cant between the force of gravity and the spine of the selected individual sitting in the associated individual seat is adjustable;

wherein the locking hinge is a mechanism that is formed within the non-Euclidean arm;

wherein the locking hinge enables the rotation of the non-Euclidean arm around the horizontally oriented axis of rotation;

wherein the locking nature of the locking hinge locks the cant between the force of gravity and the spine of the selected individual sitting in the associated individual seat into a fixed position;

wherein the slewing bearing is a fastening device;

wherein the slewing bearing attaches the congruent end of the non-Euclidean arm that is distal from the associated individual seat to the pedestal base;

wherein the slewing bearing attaches the non-Euclidean arm to the pedestal base such that the non-Euclidean arm rotates around the vertically oriented axis of rotation.

9. The dual infant rocking device according to claim 8 wherein each individual stanchion selected from the plurality of stanchion structures is a rotating structure;

wherein each selected individual stanchion rotates relative to a horizontally oriented axis of rotation such that the cant between the force of gravity and the spine of the selected individual sitting in the associated individual seat is adjustable;

wherein each selected individual stanchion further rotates relative to a vertically oriented axis of rotation such that the plurality of seats can be rotated to face each other;

wherein each selected individual seat mounts on the congruent end of the non-Euclidean prism structure of the individual stanchion selected from the plurality of stanchion structures associated with the selected individual seat.

10. The dual infant rocking device according to claim 9 wherein the plurality of limited arc motor structures comprises a collection of individual limited arc motor structures;

wherein each individual limited arc motor structure selected from the plurality of limited arc motor structures is identical.

11. The dual infant rocking device according to claim 10 wherein each individual limited arc motor structure selected from the plurality of limited arc motor structures comprises an individual limited arc motor and an individual limited arc motor controller;

wherein the individual limited arc motor, an individual limited arc motor controller, an individual potentiometer, and an individual master switch are electrically interconnected;

wherein each individual limited arc motor structure selected from the plurality of limited arc motor structures is a mechanical structure;

wherein the individual limited arc motor is an electric motor;

wherein the individual limited arc motor is a limited arc motor;

wherein the individual limited arc motor converts electric energy into a rotational energy that rotates the individual seat associated with the individual limited arc motor over a limited arc;

wherein the individual limited arc motor controller is a motor controller;

wherein the individual limited arc motor controller electrically connects to the individual limited arc motor;

wherein the individual limited arc motor controller initiates the operation of the individual limited arc motor;

wherein the individual limited arc motor controller discontinues the operation of the individual limited arc motor;

wherein the individual limited arc motor controller controls the direction of rotation of the individual limited arc motor;

wherein the individual limited arc motor controller controls the speed of rotation of the individual limited arc motor.

* * * * *